US008938834B2

(12) United States Patent
Kim et al.

(10) Patent No.: US 8,938,834 B2
(45) Date of Patent: Jan. 27, 2015

(54) FABRIC TREATING APPARATUS AND METHOD FOR CONTROLLING THE SAME

(75) Inventors: Jong Seok Kim, Seoul (KR); Dong Won Kim, Seoul (KR); Sog Kie Hong, Seoul (KR); Hea Kyung Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 1399 days.

(21) Appl. No.: 12/656,095

(22) Filed: Jan. 15, 2010

(65) Prior Publication Data

US 2010/0180645 A1 Jul. 22, 2010

(30) Foreign Application Priority Data

Jan. 16, 2009 (KR) ..... 10-2009-0003870

(51) Int. Cl.
*D06F 33/02* (2006.01)
*D06F 58/12* (2006.01)
*D06F 73/02* (2006.01)

(52) U.S. Cl.
CPC ..... *D06F 58/12* (2013.01); *D06F 73/02* (2013.01)
USPC ..... 8/158

(58) Field of Classification Search
CPC ..... D06F 58/10
USPC ..... 8/158
See application file for complete search history.

(56) References Cited

U.S. PATENT DOCUMENTS 3,739,496 A * 6/1973 Buckley et al. ..... 34/210
2006/0101867 A1 5/2006 Kleker

FOREIGN PATENT DOCUMENTS

| | | | | |
|---|---|---|---|---|
| CN | 1241657 | A | 1/2000 | |
| CN | 101311404 | A | 11/2008 | |
| CN | 101319453 | A | 12/2008 | |
| CN | 102282308 | B | 4/2013 | |
| EP | 0 653 832 | B1 | 12/1998 | |
| EP | 1865102 | | 12/2007 | |
| JP | 2001-062197 | | 3/2001 | |
| JP | 2002-84733 | * | 3/2002 | ..... D06F 33/02 |
| JP | 2002-84773 | A | 3/2002 | |
| KR | 10-2008-0081497 | | 9/2008 | |

* cited by examiner

*Primary Examiner* — Michael Barr
*Assistant Examiner* — Jason Riggleman
(74) *Attorney, Agent, or Firm* — McKenna Long & Aldridge LLP

(57) ABSTRACT

The present invention relates to a fabric treating apparatus and method for controlling the same. A fabric treating apparatus according to the present invention includes a treating space within which fabrics are treated; a heating unit configured to supply heated air, or steam, or heated air and steam to the treating chamber; a motor to generate a rotational power; a device receiving the rotational power from the motor, the device configured to move a rack disposed within the treating space; and a control unit adapted to: control the motor according to a sensed electric current of the motor, and drive the motor to rotate at a speed defined by a target number of rotations per minute.

9 Claims, 4 Drawing Sheets

FABRIC TREATING APPARATUS AND METHOD FOR CONTROLLING THE SAME

This application claims priority to Korean Application No. 10-2009-0003870, filed Jan. 16, 2009 in the Republic of Korea, which is incorporated by reference herein in its entirety.

BACKGROUND OF THE INVENTION

1. Field of the Invention

The present invention relates to fabric treating apparatus and method for controlling the same, and more specifically, to apparatus and method for controlling the same, in which a motor for moving a fabric can be effectively drived.

2. Description of the Conventional Art

Fabric treating apparatus includes all devices for managing or treating fabrics at home or in the laundry shops, such as washing, drying, removing of the wrinkles.

For example, the fabrics treating apparatus includes a washing machine for washing fabrics, a dryer for drying fabrics, a washing and drying machine having both washing function and drying function, a refresher for refreshing fabrics, and a steamer for removal of unnecessary wrinkles from fabrics The refresher is a device for making fabrics more comfortable or refreshing. The refresher performs functions of drying fabrics or supplying aroma to the fabrics or preventing generation of static electricity or removing the wrinkles from the fabrics.

The steamer is a device for merely supplying steam to fabrics for removing the wrinkles from the fabrics. The steamer removes the wrinkles more finely than a general iron, because a hot plate avoids is not contacted with the fabrics.

The fabrics treating apparatus which has functions of the steamer as well as the refresher performs functions of removing the wrinkles and the smells from the fabrics loaded in the fabrics treat apparatus using the steam and hot wind.

By these functions, the fabrics loaded in the fabrics treating apparatus can be ironing effect by removing of smelling particles or wrinkles which pollutes the fabrics. And also, it can increase the effect by moving the fabrics using the steam and hot wind.

SUMMARY OF THE INVENTION

An object of the present invention is to provide a fabric treating apparatus and method for controlling the same, which can control effectively a motor for moving a fabric.

Another object of the present invention is to provide a fabric treating apparatus and method for controlling the same, which can prevent trouble or restriction of a motor for moving a fabric.

An object of the present invention is not restricted by the above objects. The other objects which are not referred to the above will be understood by those of ordinary skill in the art that various changes in form and details may be made therein without departing from the spirit and scope of the present invention as defined by the following.

To achieve these objects, a fabric treating apparatus according to the present invention includes a treating space within which fabrics are treated; a heating unit configured to supply heated air, or steam, or heated air and steam to the treating chamber; a motor to generate a rotational power; a device receiving the rotational power from the motor, the device configured to move a rack disposed within the treating space; and a control unit adapted to: control the motor according to a sensed electric current of the motor, and drive the motor to rotate at a speed defined by a target number of rotations per minute.

To achieve these objects, method for controlling a fabric treating apparatus according to the present invention includes driving a motor coupled to a device configured to move a rack within the fabric treating apparatus, the motor driven to rotate at a target number of rotations per minute, the target number being a predefined value associated with a course of the fabric treating apparatus; sensing an electric current of the motor; and controlling the motor according to the sensed electric current.

The other exemplary embodiments described in the following embodiments and drawings.

DETAILED DESCRIPTION OF THE PREFERRED EMBODIMENT

The above and other advantages of the present invention will become more apparent by describing in detail embodiments thereof with reference to the attached drawings in which.

The present invention is not restricted by the following embodiments. It will be understood by those of ordinary skill in the art that various changes in form and details may be made therein without departing from the spirit and scope of the present invention as defined by the following claims.

Figure 1:
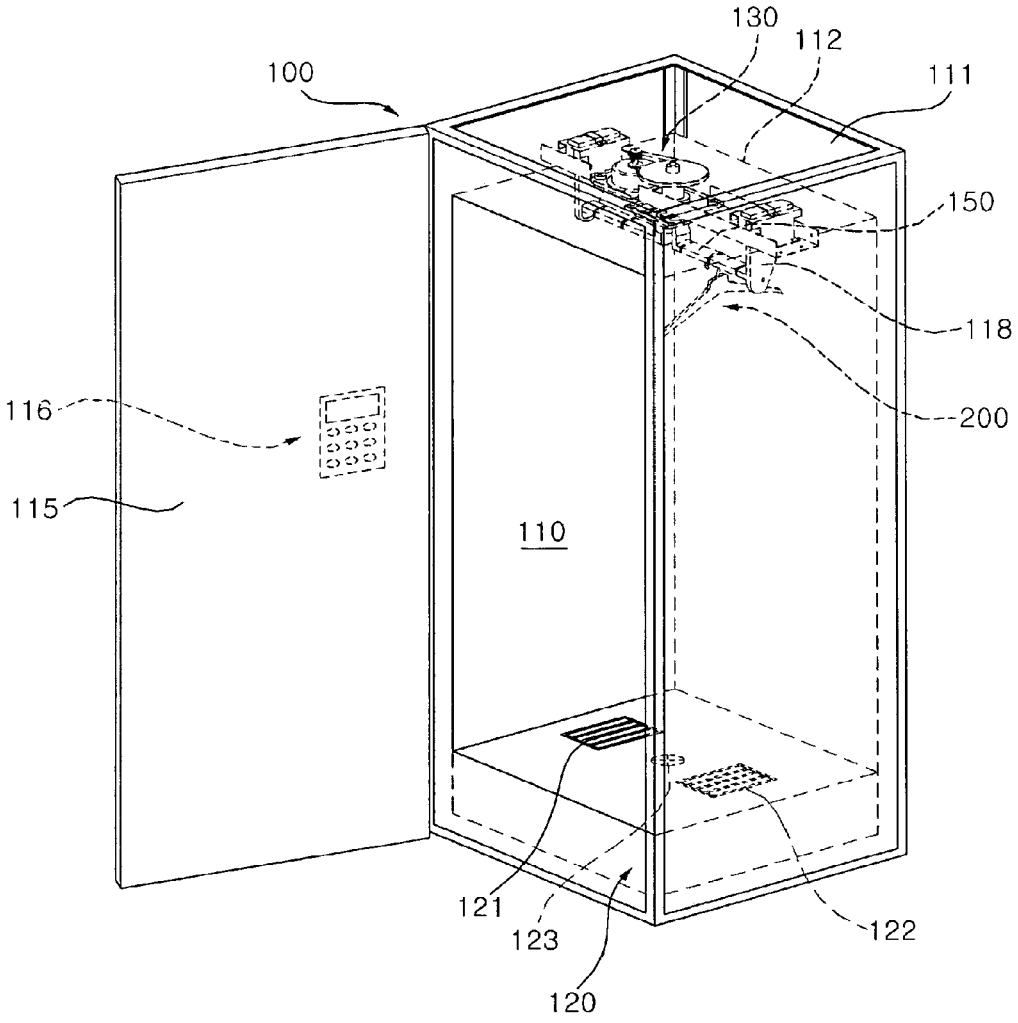
FIG. 1 illustrates a perspective view of a fabric treating apparatus in accordance with an exemplary embodiment of the present invention.
Figure 2:
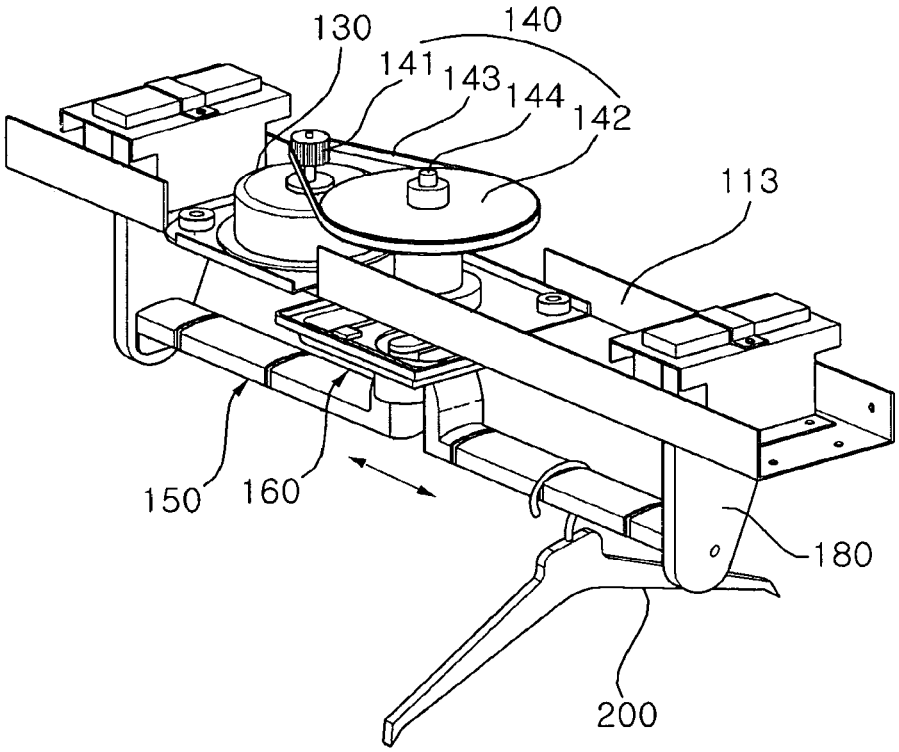
FIG. 2 illustrates a partial enlarged perspective view of FIG. 1

FIG. 1 illustrates a perspective view of a fabric treating apparatus in accordance with an exemplary embodiment of the present invention. FIG. 2 illustrates a partial enlarged perspective view of FIG. 1

A fabric treating apparatus 100 according to an exemplary embodiment of the present invention includes a outside cabinet 111, which forms the exterior of the fabrics treating apparatus, and a inside cabinet 112, which is disposed in the outside cabinet 111. A treating chamber 110 is disposed in the inside cabinet 112.

The treating chamber 110 has an opening at the side, and thus, a fabric can be loaded in the treating chamber 110 through the opening. A door 115 is disposed so as to be able to open or close the opening. If the door 115 is closed, the treating chamber 110 is isolated from the exterior. If the door 115 is opened, the treating chamber 110 is exposed to the exterior. A control panel 116 is disposed at the door 115. The control panel 116 allows a user to input an operation order and displays an operation condition of the fabrics treating apparatus. The control panel 116 includes a control unit 190 and an alarm unit 177. The control unit 190 and the alarm unit 177 will be said later. The user may select and set a treating course by using the control unit 116.

The treating chamber 110 is a space for treating a fabric to be changed the physical or chemical properties of the fabrics by supplying a steam or hot wind. Namely, the treating chamber 110 is a space for treating the fabrics by using different method. For example, in the treating chamber 110, the fabrics can be dryed by using a hot wind, or the wrinkles of the fabrics can be removed by using a steam, or the fabrics can be supplied aroma by spraying an aromatic, or the generation of static electricity of the fabrics can be prevented by spraying an antistatic.

A heating unit 120 is diposed the bottom of the treating chamber 110. More specifically, the heating unit 120 is disposed between the outside cabinet 111 and the inside cabinet 112. The heating unit 120 is able to heat the air inhaled from the treating chamber 110, and to supply the hot wind to the inside of the treating chamber 110. Also, the heating unit is able to generate a steam by heating the water, and to supply the steam to the inside of the treating chamber 110. Of course, the heating unit 120 is able to supply both the hot wind and the steam. Also, the heating unit 120 is able to supply any one between the hot wind and the steam. The heating unit 120 is variously embodied by those of ordinary skill in the scope of the present invention The heating unit 120 in accordance with an exemplary embodiment of the present invention includes an air inlet 121 for inhaling the air from the inside of the treating chamber 110, and a heater for heating the air inhaled, and an outlet 122 for discharging the hot wind heated by the heater to the inside of the treating chamber 110, and an injection nozzle 123 for injecting steam to the inside of the treating chamber 110.

The hot wind or the steam generated by the heating unit 120 supplies to the fabrics loaded in the treating chamber 110, and has an influence on the physical property or the chemical property of the fabrics. Namely, the hot wind or the steam makes the structure of the fabrics to be relaxed, so that the wrinkles of the fabrics can be removed. The steam reacts to the smell particles of the fabrics, so that an unpleasant smell can be removed. Also, the hot wind or the steam generated by the heating unit 120 has a sterilization effect on bacteria of the fabrics.

A motor 130 generates rotatory power for driving a hanger rack 150. A power transmission unit 140 transmits the rotatory power generated by the motor to a power transformation unit 160. The motor 130 is controlled by the electric current. A sensor 175 for sensing a number of rotations is disposed on the motor 130.

The motor 130 is disposed the upper part of the treating chamber 110. The motor 130 is disposed between the inside cabinet 112 and the outside cabinet 111. The motor 130 is built into a motor frame 113 fixed between the inside cabinet 112 and the outside cabinet 113. The motor frame 113 fixes the motor 130 and absorbs the vibrations generated by the driving of the motor 130. A control unit 190 and a power supply 171 are described at the following section are disposed on the motor frame 113.

The power transmission unit 140 transmits the rotatory power generated by the motor to the power transformation unit 160. The power transmission unit 140 transmits a rotary motion of the one unit to another unit. The power transmission unit 140 is variously embodied by those of ordinary skill in the scope of the present invention The power transmission unit 140 includes a driving pulley 141 rotating by the motor 130, and a driven pulley 142 rotated by a belt 143 which connects the driving pulley 140 and the driven pulley 142, and a rotary shaft 144 inserted into the driven pulley 142 and rotated by the driven pulley 142.

The power transmission unit 140 may includes a driving sprocket, a driven sprocket, and a chain, instead of said driving pulley 141, said driven pulley 142 and said belt 143. And besides, the power transmission unit 140 may includes a driving gear, a driven gear, a belt, and so on. Thus, the power transmission unit 140 is variously embodied.

The power transformation unit 160 transforms a rotary motion received from the power transmission unit 140 into a reciprocating motion of the hanger rack 150. The power transformation unit 160 may use a cam which transforms a rotary motion into a reciprocatin motion.

The hanger rack 150 is disposed in the treating chamber 110. A hanger 200 hangs over the hanger rack 150. A fabric, such as clothes, hangs over the hanger 200. The hanger rack 150 reciprocates from left to right.

A supporter 180 is connected to the treating chamber 110. A supporter 180 supports the hanger rack 150. One side of the supporter 180 is connected to the motor frame 113. The other side of the supporter 180 is connected to the hanger rack 150. The supporter 180 is made with elastic material to support a reciprocating motion of the hanger rack 150.

Figure 3:
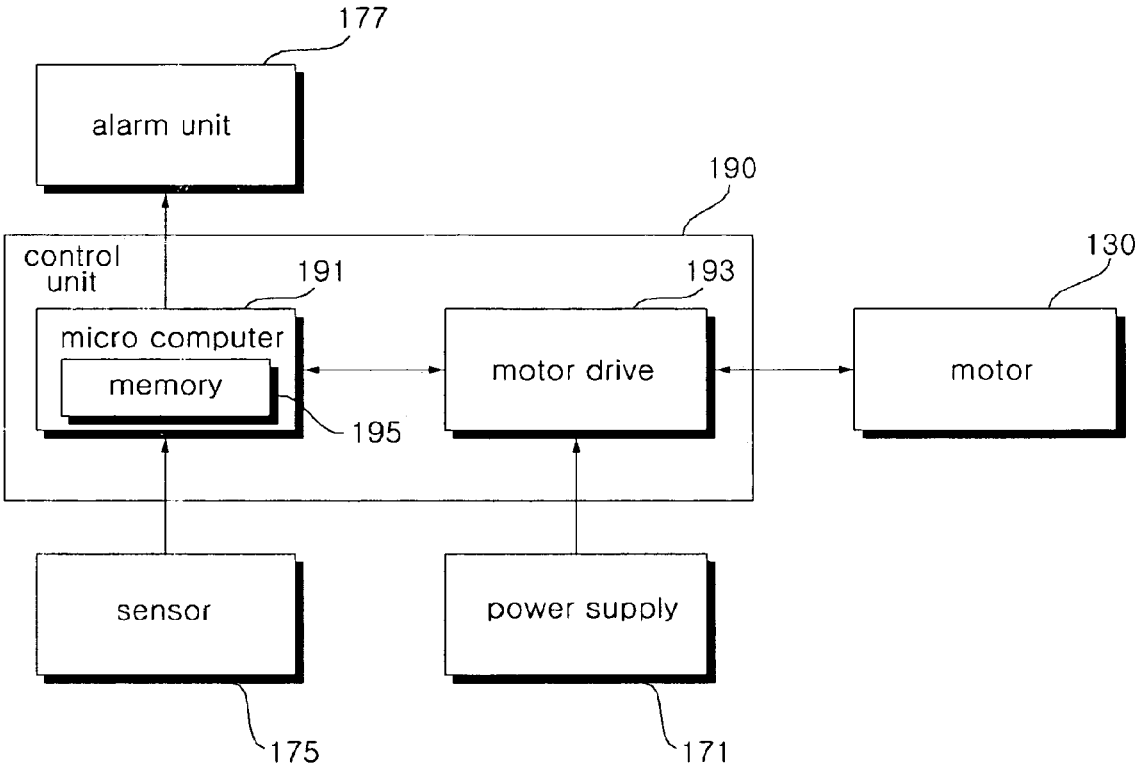
FIG. 3 illusrtates a block diagram of a fabric treating apparatus in accordance with an exemplary embodiment of the present invention.

FIG. 3 illustrates a block diagram of a fabric treating apparatus in accordance with an exemplary embodiment of the present invention.

The fabric treating apparatus according to an exemplary embodiment of the present invention includes a control unit 190, a power supply 171, a sensor 175, a alarm unit 177.

The control unit 190 controls the motor 130 according to the electric current flowing the motor 130 and rotates the motor 130 by a target number of rotations. The control unit 190 is disposed on a control panel 116 or the motor frame 113.

The control unit 190 includes a microcomputer 191 including a memory 195 which outputs a control command according to a setting data set by a user and a measurement data and so on, and a motor drive 193 which supplies a power regulated according to the control command outputted from the microcomputer 191.

The microcomputer 191 outputs a control command decided according to a command inputted by a user and the number of rotations sensed by the sensor 175 and an electric current sensed by the motor drive 193 to the motor drive 193

Figure 4:
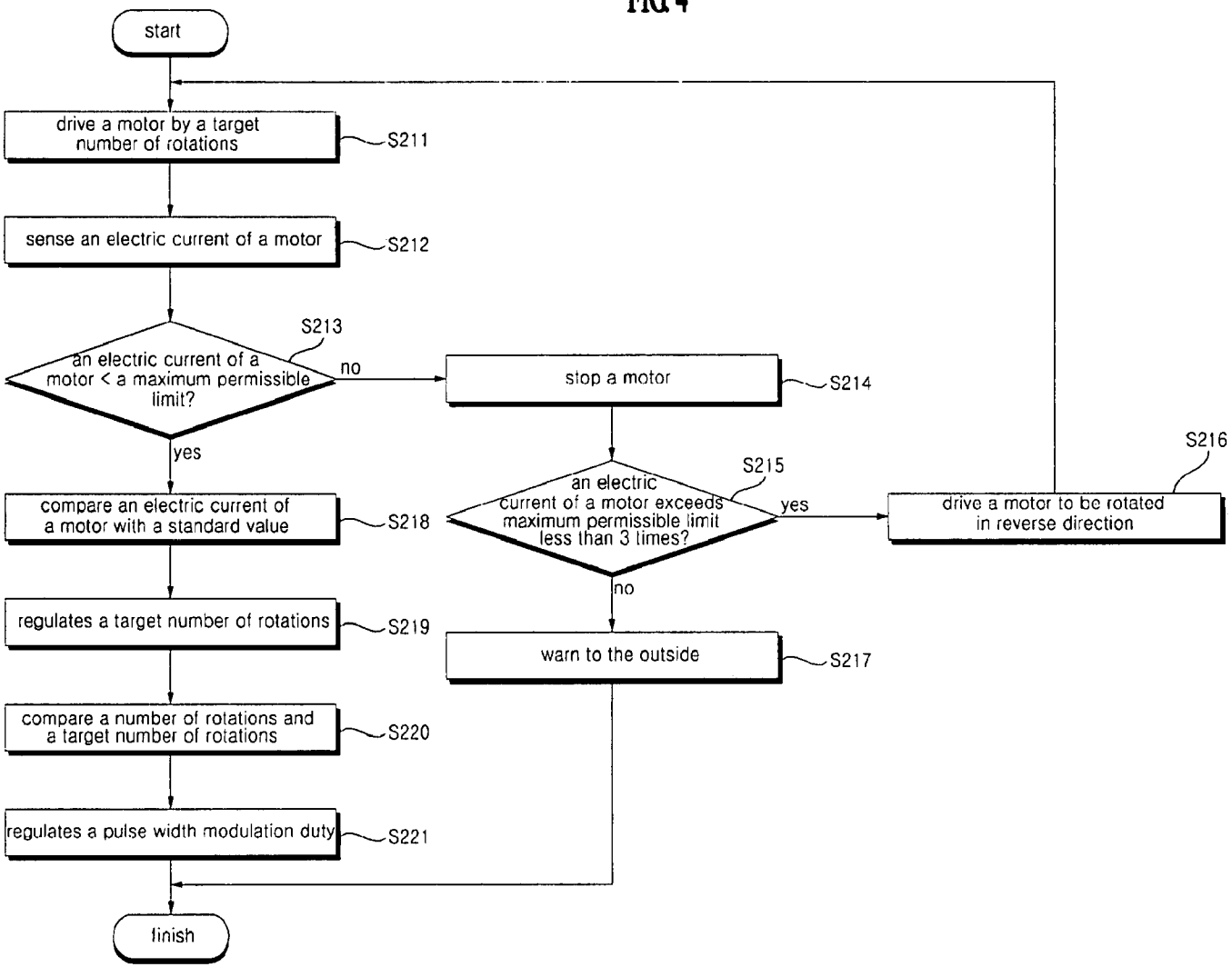
FIG. 4 illusrtates a flow chart of a method for controlling a fabric treating apparatus in accordance with an exemplary embodiment of the present invention.

The microcomputer 191 controls the motor 130 to be rotated by the target number of rotations set by the selected course by a user. And then, the microcomputer 191 regulates the target number of rotations according to the sensed electric current. Also, the microcomputer 191 outputs a control command according to a number of rotations of motor 130. Refer to FIG. 4 for further details.

The motor drive 193 regulates an electric power according to the control command outputted from the microcomputer 191, so that it may controls the motor 130. The motor drive 193 regulates a pulse width modulation (PWM) inputted from the power supply 171, so that it may regulates a number of rotations of motor 130. Thus, the motor drive 193 controls the pulse width modulation duty (PWM duty), so that it may regulates a number of rotations of motor 130.

The motor drive 193 transmits an electric current of the motor 130 to the microcomputer 191, wherein the electric current of the motor 130 reflects a load of the motor 130. The microcomputer 191 may outputs a control command according to the load of the motor.

The sensor 175 measures a number of rotations of the motor 130. The sensor 175 may a hall sensor or an optical encoder. The sensor 175 transmits the measured number of rotations to the microcomputer 191.

The alarm unit 177 warns overload of the motor 130 to the outside. The alarm unit 177 is able to warn to the outside by using a visual method or an auditory method. The alarm unit 177 is disposed on the display panel 116. Refer to FIG. 4 for further details about the alarm unit 177.

FIG. 4 illusrtates a flow chart of a method for controlling a fabric treating apparatus in accordance with an exemplary embodiment of the present invention.

If the user selects a course by using the control panel 116, the control unit 190 controls the motor 130 to be rotated by the target number of rotations set by the selected course. (S211) The user selects a course according to a quantity of the fabric or the dirty condition of the fabric. The course is divided into a strong, medium, weak, and night mode. As the course is changed from the strong mode to the night mode, the target number of rotations is controlled to be decreased. The control unit 190 controls the motor 130 to be rotated by the target number of rotations set by the selected course.

The control unit 190 senses an electric current of motor. (S212) The more load is applied to the motor, the higher electric current is applied. The control unit 190 compares the sensed electric current of the motor 130 with a maximum permissible limit of an electric current. (S213) If the sensed current of the motor is higher than a maximum permissible limit, the control unit 190 controls the motor 130 to be stopped. (S214) The maximum permissible limit is an electric current when the motor 130 is overloaded. If the motor is overloaded, the control unit 190 controls a power supply to stop an electric power supply to the motor 130.

The control unit 190 checks if the electric current of the motor 130 exceeds a maximum permissible limit less than 3 times. (S215) If the excess number is less than 3 times, the control unit 190 controls the motor to be rotated in reverse direction. (S216) The motor 130 may be overloaded, if one among the power transmission unit 140, the power transformation unit 160 and the hanger rack 150 is in a temporary trouble. Therefore, the control unit 190 controls the motor to be rotated in reverse direction, and then to be rotated by the target number of rotations. (S211)

If the excess number of times is more than three times, the control unit 190 informs the outside of the warning message. (S217) If the fabrics are so many in the treating chamber 110, or If one of among the motor 130, the power transmission unit 140, the power transformation unit 160 has a trouble, the excess number is more than 3 times. Then, the control unit 190 controls the alarm unit 177 to warn the trouble by using a visual method or an auditory method.

If an electric current of the motor 130 is lower than the maximum permissible limit, the control unit 190 compares the electric current of the motor 130 with a standard value. (S218) And then, the control unit 190 regulates the target number of rotations of the motor 130. (S219) The standard value is an electric current of the motor 130 when the motor 130 rotates by the target number of rotations in the normal conditions. In other words, the standard value is an electric current of the motor 130 when the motor 130 has a reasonable load in this case that the fabrics is hanged on the hanger rack 150 in modulation.

If the sensed current of the motor 130 is higher than the standard value, the control unit 190 controls the target number of rotations to be decreased. If the sensed current of the motor 130 is lower than the standard value, the control unit 190 controls the target number of rotations to be increased. The sensed current of the motor 130 reflects the load of the motor 130. Therefore, if the load of the motor 130 is high, the target number of rotations is regulated to be decreased so that an overload of the motor 130 can be prevented. If the load of the motor 130 is low, the target number of rotations is regulated to be increased so that the load of the motor can be high. The control unit 190 regulates the target number of rotations by regulating the pulse width modulation duty.

The control unit 190 compares the number of rotations sensed by the sensor 175 with the target number of rotations (S220), and then regulates the pulse width modulation duty. There is a difference between the target number of rotations and the realtime number of rotations because of the external condition as a fabric load. The control unit 190 controls the pulse width modulation duty to be increased when the sensed number of rotations is lower than the target number of rotations. Also the control unit 190 controls the pulse width modulation duty to be decreased when the sensed number of rotations is higher than the target number of rotations.

While the present invention has been particularly shown and described with reference to exemplary embodiments thereof, it will be understood by those of ordinary skill in the art that various changes in form and details may be made therein without departing from the spirit and scope of the present invention as defined by the following claims.

According to the present invention, there are one or more effects as described by the following.

The first, it is possible to prevent a trouble of a motor for moving a fabric.

The second, it is possible to prevent a restraint of a motor for moving a fabric.

The third, it is possible to control a motor for moving a fabric according to a load, effectively.

The fourth, it is possible to drive a motor according to the demand of a user without an overload of the motor.

What is claimed is:

1. A controlling method of a fabric treating apparatus comprising:

driving a motor coupled to a device to move a rack within the fabric treating apparatus, the motor driven to rotate at a target number of rotations per minute, the target number being a predefined value associated with a course of the fabric treating apparatus;

sensing an electric current of the motor; and controlling the motor according to the sensed electric current, wherein when the sensed electric current of the motor is greater than or equal to a preset maximum permissible limit, the motor is controlled to stop and then a number of times the sensed electric current of the motor exceeds the maximum permissible limit is checked, wherein when the sensed electric current of the motor is greater than the preset maximum permissible limit less than the predetermined number of times, a direction of rotation of the motor is reversed and the motor driven to rotate, and wherein when the sensed electric current of the motor is greater than the preset maximum permissible limit equal to or more than the predetermined number of times, the motor is controlled to remain stopped and the method generates a warning message, and wherein when the sensed electric current of the motor is less than the preset maximum permissible limit, the motor is controlled to continue rotating.

2. The controlling method of claim 1, wherein the device coupled to the motor moves the rack in a reciprocating direction.

3. The controlling method of claim 1, wherein the course is one of a plurality of courses, each of the plurality of courses being associated with at least one target number of rotations per minute.

4. The controlling method of claim 1, wherein if the sensed electric current of the motor is greater than a preset standard value, the motor is driven to decrease its speed to a speed that is less than the target number of rotations per minute.

5. The controlling method of claim 1, wherein if the sensed electric current of the motor is less than a preset standard value, the motor is driven to increase its speed to a speed that is greater than the target number of rotations per minute.

6. The controlling method of claim 1, further comprising: controlling the motor in accordance with a comparison between a measured number of rotations per minute of the motor and the target number of rotations per minute.

7. The controlling method of claim 6, wherein if the measured number of rotations per minute is less than the target number of rotations per minute, the motor is driven to increase its speed by increasing a duty cycle of a pulse width modulation signal that drives the motor.

8. The controlling method of claim 6, wherein the measured number of rotations per minute is measured in real-time.

9. A controlling method of a fabric treating apparatus comprising:

driving a motor coupled to a device to move a rack within the fabric treating apparatus, the motor driven to rotate at a target number of rotations per minute, the target number being a predefined value associated with a course of the fabric treating apparatus;

sensing an electric current of the motor;

determining if the sensed electric current of the motor is equal to or greater than a maximum permissible limit;

wherein when the sensed electric current of the motor is equal to or greater than the maximum permissible limit:

stopping the motor; and checking a number of times the sensed electric current of the motor exceeds the maximum permissible limit, wherein when the number of times the sensed electric current of the motor exceeds the maximum permissible limit is less than a predefined value:

controlling the motor to reverse its direction of rotation; and repeating the driving, sensing, and determining; and wherein when the number of times the sensed electric current of the motor exceeds the maximum permissible limit is not less than the predefined value:

transmitting an alarm signal.

* * * * *